US010033124B2

(12) United States Patent
Kato et al.

(10) Patent No.: US 10,033,124 B2
(45) Date of Patent: Jul. 24, 2018

(54) ELECTRICAL CONTACT PAIR AND CONNECTOR TERMINAL PAIR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Akihiro Kato, Mie (JP); Takahiro Sunaga, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/549,782

(22) PCT Filed: Feb. 3, 2016

(86) PCT No.: PCT/JP2016/053256

§ 371 (c)(1),
(2) Date: Aug. 9, 2017

(87) PCT Pub. No.: WO2016/132908

PCT Pub. Date: Aug. 25, 2016

(65) Prior Publication Data

US 2018/0026385 A1 Jan. 25, 2018

(30) Foreign Application Priority Data

Feb. 19, 2015 (JP) ..... 2015-030389

(51) Int. Cl.
*H01R 13/03* (2006.01)

(52) U.S. Cl.
CPC ..... *H01R 13/03* (2013.01)

(58) Field of Classification Search
CPC ..... H01R 13/03; H01R 43/16; H01R 12/57; H01R 24/28; H01R 24/60; H01R 13/516;
(Continued)

(56) References Cited

U.S. PATENT DOCUMENTS 5,327,318 A * 7/1994 Popat ..... B23Q 17/22 361/103
2003/0071245 A1* 4/2003 Harris, IV ..... H01C 7/027 252/500

(Continued)

FOREIGN PATENT DOCUMENTS

JP 2008-270192 A 11/2008
JP 2013-231228 A 11/2008

OTHER PUBLICATIONS

International Preliminary Report on Patentability for Application No. PCT/JP2016/053256 dated Jul. 25, 2016; 15 pages.

(Continued)

*Primary Examiner* — Truc Nguyen
(74) *Attorney, Agent, or Firm* — Reising Ethington, P.C.

(57) ABSTRACT

An electrical contact pair and a connector terminal pair that can reduce the amount of sliding wear in a contact portion. The electrical contact pair includes a first electrical contact, a second electrical contact, and a contact portion. The first electrical contact includes, above a first conductive base material, an Ag—Sn alloy layer, and a first AG layer that is laminated on a surface of the Ag—Sn alloy layer, and the first AG layer is exposed as the outermost surface. The second electrical contact includes a second AG layer above a second conductive base material, and the second AG layer is exposed as the outermost surface. The contact portion is obtained as a result of a surface of the first AG layer of the first electrical contact and a surface of the second AG layer (Continued)

of the second electrical contact being in contact with each other.

5 Claims, 4 Drawing Sheets

(58) Field of Classification Search
CPC ..... H01R 12/714; H01R 13/6683; H01R 12/7082; H01R 12/716; H01R 13/642; H01R 13/6588; H01R 13/6691; H01R 2103/00
See application file for complete search history.

(56) References Cited

U.S. PATENT DOCUMENTS

2003/0186597 A1* 10/2003 Suzuki ..... H01R 13/03 439/886
2005/0221657 A1* 10/2005 Hisaeda ..... H01R 13/20 439/367
2008/0139058 A1* 6/2008 Oda ..... C25D 5/12 439/887
2010/0186993 A1 7/2010 Yamaguchi et al.
2013/0029538 A1* 1/2013 Ihara ..... H01R 13/2442 439/733.1
2014/0162506 A1* 6/2014 De Cloet ..... C23C 30/00 439/886
2015/0079422 A1 3/2015 Sunaga et al.
2015/0287505 A1* 10/2015 Jung ..... H01C 17/02 338/272
2015/0295333 A1* 10/2015 Shibuya ..... C25D 5/10 439/887
2016/0064847 A1* 3/2016 Gaertner ..... C23C 2/06 439/741
2016/0254608 A1* 9/2016 Takahashi ..... C25D 3/12 439/886

OTHER PUBLICATIONS

International Search Report for Application No. PCT/JP2016/053256 dated Mar. 8, 2016; 6 pages.

* cited by examiner

ELECTRICAL CONTACT PAIR AND CONNECTOR TERMINAL PAIR

CROSS REFERENCE TO RELATED APPLICATIONS

This application claims the priority of Japanese patent application JP2015-030389 filed on Feb. 19, 2015, the entire contents of which are incorporated herein.

TECHNICAL FIELD

The present invention relates to an electrical contact pair and a connector terminal pair.

BACKGROUND ART

In recent years, following the spread of hybrid automobiles, electric automobiles, and the like, high-current connector terminals have been used for, for example, power supply lines for supplying electric power to a motor and the like. Typically, electrical contacts of this type of connector terminal employ Ag plating, which has low contact resistance. When the connector terminals are fitted to each other, the Ag layers of electrical contacts are brought into contact with each other, and a contact portion of a pair of electrical contacts is formed.

For example, Patent Document 1 (JP2013-231228A) discloses, as the above-described connector terminal, a connector terminal that is constituted by a plated member including: a base material made of Cu or a Cu alloy; an Ag—Sn alloy layer that covers a surface of the base material; and an Ag layer that covers the Ag—Sn alloy layer, and is exposed as the outermost surface.

SUMMARY

However, in the conventional technology, there is room for improvement in the following respects. That is, Ag is a metal that is relatively soft and is easy to adhere to. Accordingly, a pair of electrical contacts that has a contact portion in which Ag layers are in contact with each other is likely to wear due to the adhesion of Ag, and thus has poor wear-resistance. Particularly, if the pair of electrical contacts is subjected to friction due to sliding, then the wear due to the adhesion becomes significant. If significant wear occurs, then a base material, or a lower layer whose contact resistance is larger than that of the Ag layer will be exposed to the surface, and constitute the contact portion, resulting in a decrease in the connection reliability of a pair of connector terminals.

In this respect, in Patent Document 1, the relatively hard Ag—Sn alloy layer is provided under the Ag layer to reduce the friction coefficient of the surface, ensuring the wear-resistance of the pair of electrical contacts. However, even if such a configuration is employed, there may be cases where the amount of wear in the contact portion during sliding (sliding wear) cannot be reduced sufficiently.

The present design was made in view of the above-described circumstances, and it is an object thereof to provide an electrical contact pair and a connector terminal pair that can reduce the amount of sliding wear in a contact portion.

According to one aspect of the present design, an electrical contact pair includes:

a first electrical contact that includes a first conductive base material, an Ag—Sn (silver-tin) alloy layer that is laminated on a surface of the first conductive base material with a Ni (nickel) layer and/or a Ni alloy layer interposed therebetween, and a first AG (silver) layer that is laminated on a surface of the Ag—Sn alloy layer, the first AG layer being exposed as an outermost surface;

a second electrical contact that includes a second conductive base material, and a second AG layer that is laminated on a surface of the second conductive base material with a Ni layer and/or a Ni alloy layer interposed therebetween, the second AG layer being exposed as an outermost surface; and a contact portion in which a surface of the first AG layer of the first electrical contact and a surface of the second AG layer of the second electrical contact are in contact with each other, wherein contact pressure that is exerted on the contact portion is in a range from 100 $N/mm^2$ to 500 $N/mm^2$ inclusive.

According to another aspect of the present design, a connector terminal pair includes the above-described electrical contact pair.

The electrical contact pair includes the contact portion in which a surface of the first AG layer of the first electrical contact and a surface of the second AG layer of the second electrical contact are in contact with each other. Here, the first electrical contact includes, under the first AG layer, the Ag—Sn alloy layer that is harder than the first AG layer. Accordingly, the first electrical contact has a smaller friction coefficient of the outermost surface, and thus has improved sliding wear-resistance. Furthermore, in the electrical contact pair, the contact pressure that is exerted on the contact portion is set to be in a range from 100 $N/mm^2$ to 500 $N/mm^2$ inclusive. In other words, in the electrical contact pair, the contact pressure that is exerted on the contact portion constituted by the first electrical contact and the second electrical contact that have the above-described configurations is restricted to be in a range from 100 $N/mm^2$ to 500 $N/mm^2$ inclusive. Accordingly, the electrical contact pair can reduce the amount of sliding wear in the contact portion compared to a case where the contact pressure that is exerted on the contact portion exceeds 500 $N/mm^2$.

Furthermore, the connector terminal pair includes the above-described electrical contact pair. Accordingly, the connector terminal pair can reduce the amount of sliding wear in the contact portion. Therefore, the connector terminal pair can maintain high connection reliability.

DESCRIPTION OF EMBODIMENTS

Figure 1:
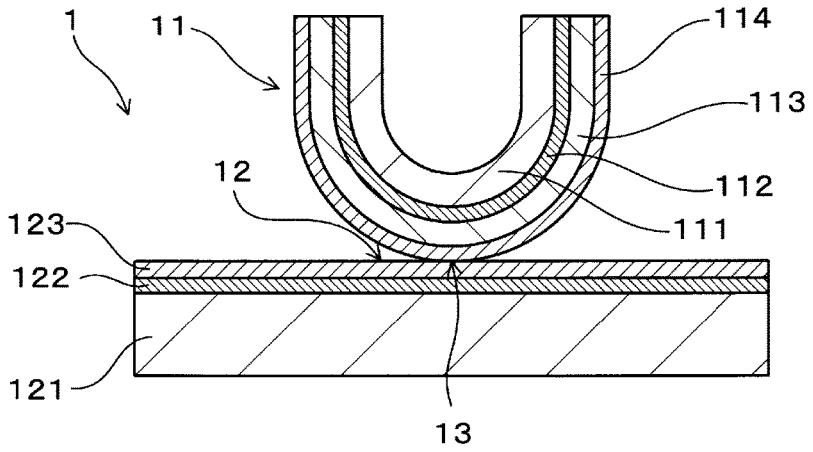
FIG. 1 is a cross-sectional view schematically illustrating an electrical contact pair according to Embodiment 1.

In the electrical contact pair, the contact pressure that is exerted on the contact portion is set to be not greater than 500 N/mm$^2$. Note that the contact pressure that is exerted on the contact portion can be calculated by dividing a load (N) that is exerted on the contact portion by a contact area (mm$^2$) of the contact portion in which the first AG layer and the second AG layer are in contact with each other.

In view of easily reducing the amount of sliding wear in the contact portion, the contact pressure that is exerted on the contact portion may preferably be not greater than 490 N/mm$^2$, more preferably not greater than 480 N/mm$^2$, further preferably not greater than 470 N/mm$^2$, yet further preferably not greater than 460 N/mm$^2$, and even further preferably not greater than 450 N/mm$^2$. Note that the contact pressure that is exerted on the contact portion is set to be equal to or greater than 100 N/mm$^2$.

In the electrical contact pair, the first electrical contact includes, the first conductive base material, the Ag—Sn alloy layer that is laminated on a surface of the first conductive base material with another metal layer (including an alloy thereof, this provision is hereinafter omitted) interposed therebetween, and the first AG layer that is laminated on a surface of the Ag—Sn alloy layer, and the first AG layer is exposed as an outermost surface.

In the electrical contact pair, the second electrical contact includes the second conductive base material, and the second AG layer that is laminated on a surface of the second conductive base material with another metal layer interposed therebetween, and the second AG layer is exposed as an outermost surface.

The electrical contact pair includes, as the other metal layers, a Ni layer and/or a Ni alloy layer between the first conductive base material and the Ag—Sn alloy layer, and/or, between the second conductive base material and the second AG layer.

A Ni layer and a Ni alloy layer have high heat resistance. Accordingly, in this case, even if the electrical contact pair is exposed to a high-temperature environment, the Ni layer or the Ni alloy layer can block an oxide formation element (such as a Cu element of the conductive base materials, for example) from diffusing toward the surface from below the Ni layer or the Ni alloy layer. Therefore, an insulating oxide is unlikely to be generated in the contact portion, and an increase in the contact resistance is easily suppressed.

In the electrical contact pair, the first conductive base material and the second conductive base material may be made of copper or a copper alloy, or aluminum or an aluminum alloy.

If the first conductive base material and the second conductive base material are made of copper or a copper alloy, then it is possible to achieve an electrical contact pair suitable for a connector terminal pair that includes a conductive base material made of copper or a copper alloy. Furthermore, if the first conductive base material and the second conductive base material are made of aluminum or an aluminum alloy, then it is possible to achieve an electrical contact pair suitable for a connector terminal pair that includes a conductive base material made of aluminum or an aluminum alloy.

The electrical contact pair may have a configuration in which the first electrical contact has a protruding shape, and the second electrical contact has the shape of a plate that comes into electrical contact with the top of the protruding first electrical contact. Furthermore, a configuration is also possible in which the second electrical contact has a protruding shape, and the first electrical contact has the shape of a plate that comes into electrical contact with the top of the protruding second electrical contact. Furthermore, the electrical contact pair may also have a configuration in which the first electrical contact includes a bent portion, and the second electrical contact has the shape of a plate that comes into electrical contact with the bent portion of the first electrical contact. A configuration is also possible in which the second electrical contact includes a bent portion, and the first electrical contact has the shape of a plate that comes into electrical contact with the bent portion of the second electrical contact.

The electrical contact pair may have a configuration in which the first AG layer is thinner than the second AG layer. In this case, it is easy to achieve both an effect in which the relatively hard Ag—Sn alloy layer provided under the first AG layer reduces the friction coefficient of the outermost surface of the first electrical contact, and an effect in which the second AG layer that is thicker than the first AG layer reduces the contact resistance.

The connector terminal pair includes the above-described electrical contact pair. The connector terminal pair may have one or more such electrical contact pairs. Furthermore, the connector terminal pair may include, in addition to the above-described electrical contact pair, an electrical contact pair that has a different configuration from that of the above-described electrical contact pair. The connector terminal pair may preferably have a configuration in which all of its electrical contact pairs are electrical contact pairs as described above. In this case, it is possible to reduce the amount of sliding wear in all of the contact portions, making it possible to achieve a connector terminal pair that can easily maintain high connection reliability.

Specifically, the connector terminal pair may have a configuration in which a first terminal that includes the first electrical contact, and a second terminal that includes the second electrical contact are provided, and the first terminal and the second terminal are fitted to each other to form the contact portion. In this case, a connector terminal pair that includes the above-described electrical contact pair can be ensured.

More specifically, for example, the first terminal may have a female terminal shape with a protrusion portion that serves as the first electrical contact, and the second terminal may have a male terminal shape with a plate-shaped portion that comes into contact with the top of the protrusion portion, and serves as the second electrical contact. In this case, the first terminal may have one or more protrusion portions, and the second terminal may have one or more plate-shaped portions. Furthermore, the second terminal may have a female terminal shape with a protrusion portion that serves as the second electrical contact, and the first terminal may have a male terminal shape with a plate-shaped portion that comes into contact with the top of the protrusion portion, and serves as the first electrical contact. In this case, the second terminal may have one or more protrusion portions, and the first terminal may have one or more plate-shaped portions.

Furthermore, for example, the first terminal may have a female terminal shape with a bent portion that serves as the first electrical contact, and the second terminal may have a male terminal shape with a plate-shaped portion that comes into contact with the bent portion, and serves as the second electrical contact. In this case, the first terminal may have one or more bent portions, and the second terminal may have one or more plate-shaped portions. Furthermore, the second terminal may have a female terminal shape with a bent portion that serves as the second electrical contact, and the first terminal may have a male terminal shape with a plate-shaped portion that comes into contact with the bent portion, and serves as the first electrical contact. In this case, the second terminal may have one or more bent portions, and the first terminal may have one or more bent portions.

Note that the above-described configurations may appropriately be combined with each other, as needed, in order to, for example, achieve the above-described effects, functions, and the like.

Embodiments

Hereinafter, an electrical contact pair and a connector terminal pair according to embodiments will be described with reference to the drawings.

Embodiment 1

An electrical contact pair and a connector terminal pair according to Embodiment 1 will be described with reference to FIGS. 1 and 2. As shown in FIG. 1, an electrical contact pair 1 of the present embodiment includes a first electrical contact 11, a second electrical contact 12, and a contact portion 13. The first electrical contact 11 includes, a first conductive base material 111, an Ag—Sn alloy layer 113 that is laminated on a surface of the first conductive base material 111 with Ni layer 112 and/or a Ni alloy layer interposed therebetween, and a first AG layer 114 that is laminated on a surface of the Ag—Sn alloy layer 113. In the first electrical contact 11, the first AG layer 114 is exposed as the outermost surface. The second electrical contact 12 a second conductive base material 121, and a second AG layer 123 that is laminated on a surface of the second conductive base material 121 with a Ni layer 122 and/or a Ni alloy layer interposed therebetween. Note that in the electrical contacts 11 and 12, "upper sides" refer to sides on which the layers are formed on the conductive base materials 111 and 121, which serve as references. In the second electrical contact 12, the second AG layer 123 is exposed as the outermost surface. The contact portion 13 is obtained as a result of a surface of the first AG layer 114 of the first electrical contact 11 and a surface of the second AG layer 123 of the second electrical contact 12 being in contact with each other. The contact pressure that is exerted on the contact portion 13 is set to be in a range from 100 N/mm$^2$ to 500 N/mm$^2$ inclusive. This will be described in detail below.

In the present embodiment, the first electrical contact 11 has a protruding shape. Specifically, the first electrical contact 11 has the protruding first conductive base material 111, a Ni layer 112 that is laminated on a surface of the first conductive base material 111, the Ag—Sn alloy layer 113 that is laminated on a surface of the Ni layer 112, and the first AG layer 114 that is laminated on a surface of the Ag—Sn alloy layer 113. The first conductive base material 111 is made of copper or a copper alloy, and has a thickness of 250 μm. The Ni layer 112 has a thickness of 1 μm. The Ag—Sn alloy layer 113 has a thickness of 4 μm. The first AG layer 114 has a thickness of 1 μm.

On the other hand, in the present embodiment, the second electrical contact 12 has the shape of a plate that comes into electrical contact with the top of the protruding first electrical contact 11. Specifically, the second electrical contact 12 includes the plate-shaped second conductive base material 121, a Ni layer 122 that is laminated on a surface of the second conductive base material 121, and the second AG layer 123 that is laminated on a surface of the Ni layer 122. The second conductive base material 121 is made of copper or a copper alloy, and has a thickness of 250 μm. The Ni layer 122 has a thickness of 1 μm. The second AG layer 123 has a thickness of 5 μm. Note that the Ni layer 112 of the first electrical contact 11, and the Ni layer 122 of the second electrical contact 12 may be replaced by Ni alloy layers.

Figure 2:
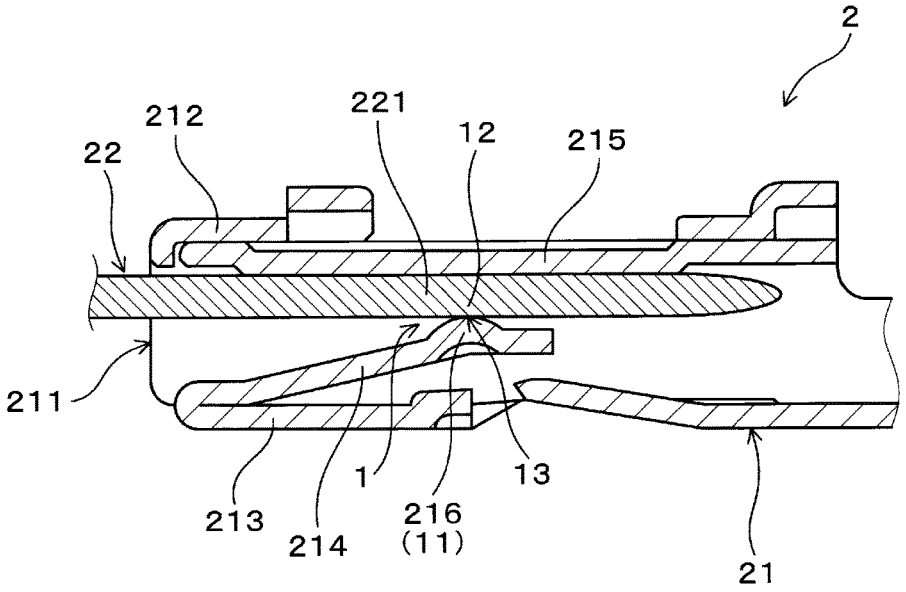
FIG. 2 is a cross-sectional view schematically illustrating a connector terminal pair according to Embodiment 1.

As shown in FIG. 2, a connector terminal pair 2 of the present embodiment includes the electrical contact pair 1. This will be described in detail below.

In the present embodiment, the connector terminal pair 2 includes a first terminal 21 that has the first electrical contact 11, and a second terminal 22 that has the second electrical contact 12. The first terminal 21 and the second terminal 22 of the connector terminal pair 2 are fitted to each other to form the contact portion 13. Note that in the present embodiment, the first terminal 21 includes one first electrical contact 11, and the second terminal 22 includes one second electrical contact 12. Accordingly, the connector terminal pair 2 of the present embodiment includes one electrical contact pair 1, and thus includes one contact portion 13 that has contact pressure set to be in a range from 100 N/mm$^2$ to 500 N/mm$^2$ inclusive.

The connector terminal pair 2 is used in an automotive wire harness (not shown). More specifically, the connector terminal pair 2 is applied to an automotive power supply line through which a high current flows. Specifically, the first terminal 21 is a female terminal. Specifically, the second terminal 22 is a male terminal.

More specifically, the first terminal 21 includes a tubular portion 212 that has, at the front end thereof, an insertion port 211 that is open. On the other hand, the second terminal 22 has a plate-shaped portion 221 that is inserted into the insertion port 211 of the first terminal 21. The tubular portion 212 of the first terminal 21 is provided with, inside thereof, an elastic contact piece 214 that is formed as a result of a bottom plate 213 being folded inward to the rear side. The elastic contact piece 214 is configured to apply an upward force to the inserted plate-shaped portion 221 of the second terminal 22. The plate-shaped portion 221 of the second terminal 22 is pressed against the inner surface of a ceiling plate 215 of the tubular portion 212 by the elastic contact piece 214. Accordingly, the plate-shaped portion 221 of the second terminal 22 is held while being interposed and pressed between the elastic contact piece 214 and the inner surface of the ceiling plate 215.

The elastic contact piece 214 is provided with a protrusion portion 216. The protrusion portion 216 is formed by causing the elastic contact piece 214 to bulge in a hemispherical shape from the bottom surface toward the top surface thereof. In the present embodiment, the protrusion portion 216 of the elastic contact piece 214 serves as the first electrical contact 11. Furthermore, the part of the plate-shaped portion 221 of the second terminal 22 that is in contact with the top of the protrusion portion 216, and the peripheral part thereof serve as the second electrical contact 12.

Note that in the present embodiment, the portion of the first terminal 21 other than the elastic contact piece 214 including the first electrical contact 11 has a structure in which a Ni layer is laminated on a surface of a conductive base material made of copper or a copper alloy, and a Sn layer or a Sn alloy layer is laminated on a surface of the Ni layer. The conductive base material constituting the first terminal 21 is contiguous with the first conductive base material 111 of the first electrical contact 11. Furthermore, the portion (not shown) of the second terminal 22 other than the plate-shaped portion 221 including the second electrical contact 12 has a structure in which a Ni layer is laminated on a surface of a conductive base material made of copper or a copper alloy, and a Sn layer or a Sn alloy layer is laminated on a surface of the Ni layer. The conductive base material constituting the second terminal 22 is contiguous with the second conductive base material 121 of the second electrical contact 12.

The following will describe effects and functions of the electrical contact pair and the connector terminal pair according to the present embodiment.

The electrical contact pair 1 of the present embodiment includes the contact portion 13 in which the surface of the first AG layer 114 of the first electrical contact 11 and the surface of the second AG layer 123 of the second electrical contact 12 are in contact with each other. Here, the first electrical contact 11 includes, under the first AG layer 114, the Ag—Sn alloy layer 113 that is harder than the first AG layer 114. Accordingly, the first electrical contact 11 has a small friction coefficient of the outermost surface, and thus has improved sliding wear-resistance. Furthermore, in the electrical contact pair 1 of the present embodiment, the contact pressure that is exerted on the contact portion 13 is set to be in a range from 100 $N/mm^2$ to 500 $N/mm^2$ inclusive. In other words, in the electrical contact pair 1 of the present embodiment, the contact pressure that is exerted on the contact portion 13 constituted by the first electrical contact 11 and the second electrical contact 12 that have the above-described configurations is restricted to be in range from 100 $N/mm^2$ to 500 $N/mm^2$ inclusive. Accordingly, the electrical contact pair 1 of the present embodiment can reduce the amount of sliding wear in the contact portion 13 compared to a case where the contact pressure that is exerted on the contact portion 13 exceeds 500 $N/mm^2$.

Furthermore, the connector terminal pair 2 of the present embodiment includes the electrical contact pair 1 of the present embodiment. Accordingly, the connector terminal pair 2 of the present embodiment can reduce the amount of sliding wear in the contact portion 13. Therefore, the connector terminal pair 2 of the present embodiment can maintain high connection reliability.

Embodiment 2

Figure 3:
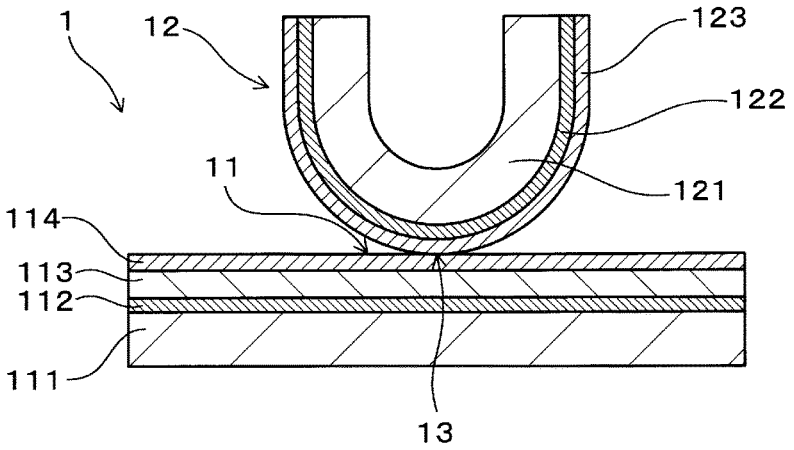
FIG. 3 is a cross-sectional view schematically illustrating an electrical contact pair according to Embodiment 2.

An electrical contact pair and connector terminals according to Embodiment 2 will be described with reference to FIG. 3. As shown in FIG. 3, according to the present embodiment, a second electrical contact 12 of an electrical contact pair 1 has a protruding shape. Specifically, the second electrical contact 12 includes a protruding shape second conductive base material 121, a Ni alloy layer 122 that is laminated on a surface of the second conductive base material 121, and a second AG layer 123 that is laminated on a surface of the Ni alloy layer 122. The second conductive base material 121 is made of copper or a copper alloy, and has a thickness of 250 μm. The Ni alloy layer 122 has a thickness of 1 μm. The second AG layer 123 has a thickness of 1 μm.

On the other hand, in the present embodiment, a first electrical contact 11 has the shape of a plate that comes into electrical contact with the top of the protruding second electrical contact 12. Specifically, the first electrical contact 11 includes a plate-shaped first conductive base material 111, a Ni alloy layer 112 that is laminated on a surface of the first conductive base material 111, an Ag—Sn alloy layer 113 that is laminated on a surface of the Ni alloy layer 112, and a first AG layer 114 that is laminated on a surface of the Ag—Sn alloy layer 113. The first conductive base material 111 is made of copper or a copper alloy, and has a thickness of 250 μm. The Ni alloy layer 112 has a thickness of 1 μm. The Ag—Sn alloy layer 113 has a thickness of 4 μm. The first AG layer 114 has a thickness of 1 μm. Other configurations are the same as those of the electrical contact pair 1 of Embodiment 1.

Furthermore, a connector terminal pair (not shown) of the present embodiment has a first terminal that is a male terminal, and a second terminal that is a female terminal. That is, the connector terminal pair of the present embodiment has an inversed configuration of the male and female terminals with respect to the configuration of the connector terminal pair of Embodiment 1. Accordingly, in the present embodiment, a protrusion portion of an elastic contact piece serves as the second electrical contact. Furthermore, the part of the plate-shaped portion of the first terminal that is in contact with the top of the protrusion portion, and the peripheral part thereof serve as the first electrical contact. Other configurations are the same as those of the connector terminal pair of Embodiment 1.

The electrical contact pair and the connector terminal pair of the present embodiment can also achieve the same effects and functions as those of the electrical contact pair and the connector terminal pair of Embodiment 1.

Reference Example 3

Figure 4:
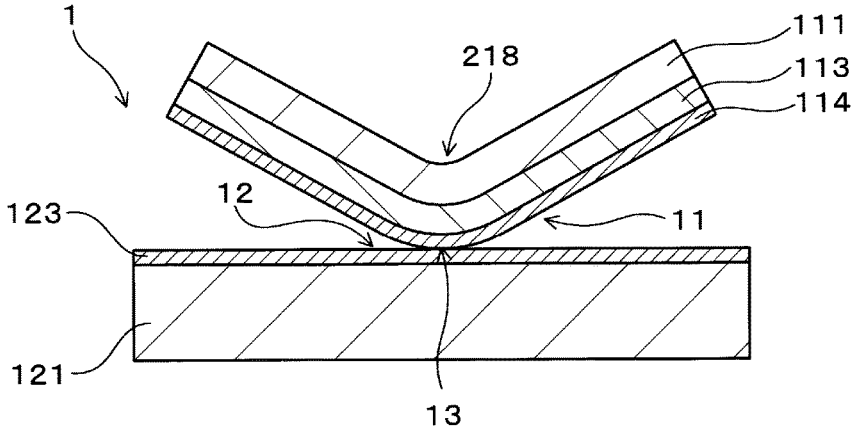
FIG. 4 is a cross-sectional view schematically illustrating an electrical contact pair according to Reference Example 3.

An electrical contact pair and a connector terminal according to Reference Example 3 will be described with reference to FIGS. 4 to 6. As shown in FIG. 4, a first electrical contact 11 of the present embodiment includes a bent portion 218. Specifically, the first electrical contact 11 includes a first conductive base material 111 that is folded to have the bent portion 218, an Ag—Sn alloy layer 113 that is laminated on a surface of the first conductive base material 111, and a first AG layer 114 that is laminated on a surface of the Ag—Sn alloy layer 113. The first conductive base material 111 is made of aluminum or an aluminum alloy, and has a thickness of 250 μm. The Ag—Sn alloy layer 113 has a thickness of 4 μm. The first AG layer 114 has a thickness of 1 μm.

On the other hand, in the present embodiment, a second electrical contact 12 has the shape of a plate that comes into electrical contact with the bent portion 218 of the first electrical contact 11. Specifically, the second electrical contact 12 includes a plate-shaped second conductive base material 121, and a second AG layer 123 that is laminated on a surface of the second conductive base material 121. The second conductive base material 121 is made of aluminum or an aluminum alloy, and has a thickness of 250 μm. The second AG layer 123 has a thickness of 5 μm. Other configurations are the same as those of the electrical contact pair 1 of Embodiment 1.

Figure 5:
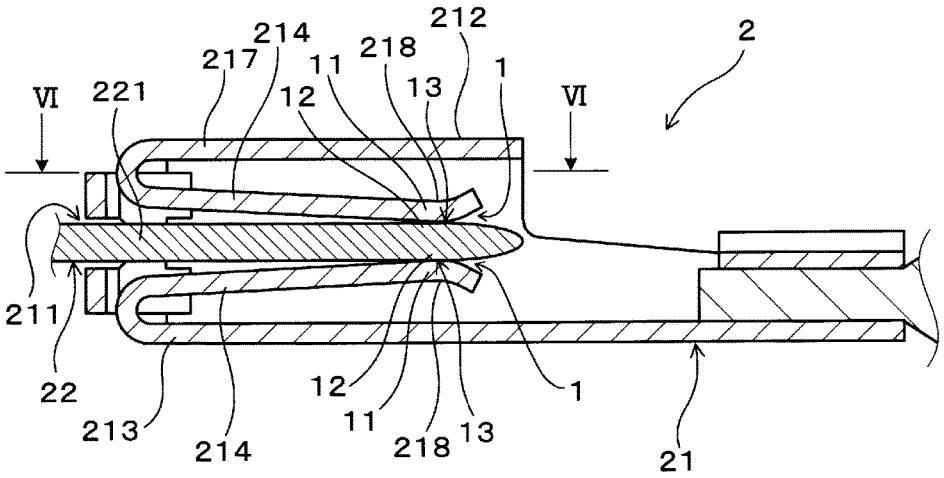
FIG. 5 is a cross-sectional view taken along a line V-V schematically illustrating a connector terminal pair according to Reference Example 3.
Figure 6:
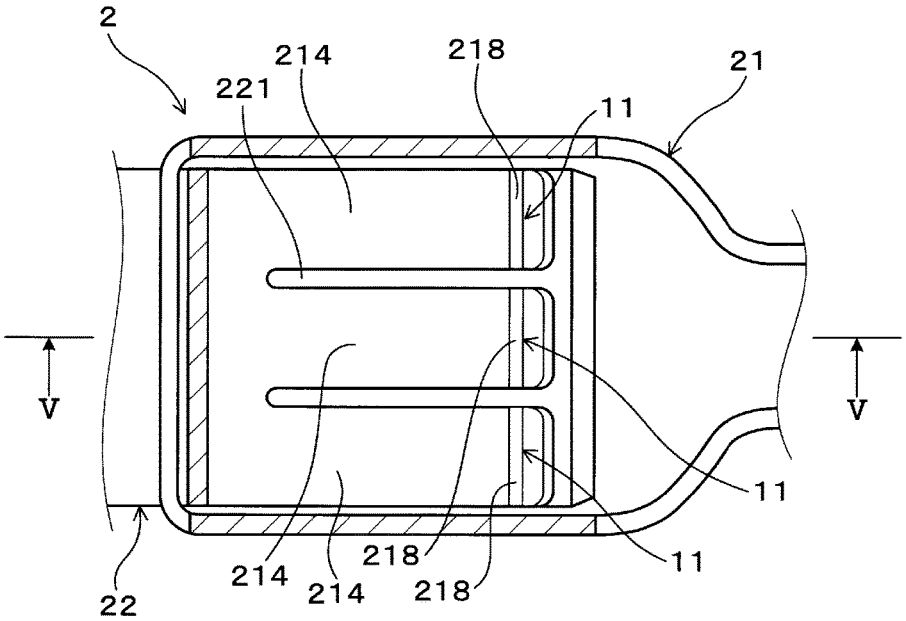
FIG. 6 is a cross-sectional view taken along a line VI-VI schematically illustrating the connector terminal pair of Reference Example 3.

Similar to the connector terminal pair 1 of Embodiment 1, a connector terminal pair 2 of the present embodiment includes, as shown in FIGS. 5 and 6, a first terminal 21 that includes the first electrical contact 11, and a second terminal 22 that includes the second electrical contact 12. Also, the first terminal 21 and the second terminal 22 of the connector terminal pair 2 are fitted to each other to form a contact portion 13.

Note that in the present embodiment, the first terminal 21 includes six first electrical contacts 11, and the second terminal 22 includes, on one plate-shaped portion 221 thereof, six second electrical contacts 12. Accordingly, the connector terminal pair 2 of the present embodiment includes six electrical contact pairs 1, and six contact portions 13 whose contact pressure are set to be in range from 100 $N/mm^2$ to 500 $N/mm^2$ inclusive. That is, the connector terminal pair 2 includes a plurality of electrical contact pairs, and all of the electrical contact pairs are the electrical contact pair 1 as described above.

More specifically, the tubular portion 212 of the first terminal 21 is provided with, inside thereof, three pairs of elastic contact pieces 214 that are formed as a result of a top plate 217 and a bottom plate 213 being folded inward to the rear side. The three elastic contact pieces 214 arranged on the top plate 217 side are configured to apply a downward force to the inserted plate-shaped portion 221 of the second terminal 22. Furthermore, the three elastic contact pieces 214 that are arranged on the bottom plate 213 side facing the three elastic contact pieces 214 arranged on the top plate 217 side are configured to apply an upward force to the inserted plate-shaped portion 221 of the second terminal 22. Accordingly, the plate-shaped portion 221 of the second terminal 22 is held while being interposed and pressed between the three pairs of elastic contact pieces 214.

Each elastic contact piece 214 includes a bent portion 218. The bent portion 218 is formed by folding and bending the front end of the elastic contact piece 214 to the side facing away from the second terminal 22 side. In the present embodiment, the bent portion 218 of each elastic contact piece 214 serves as a first electrical contact 11. Furthermore, the part of the plate-shaped portion 221 of the second terminal 22 that is in contact with the top of the bent portion 218, and the peripheral part thereof serve as the second electrical contact 12. Other configurations are the same as those of the connector terminal pair 1 of Embodiment 1.

The electrical contact pairs and the connector terminal pair of the present embodiment can also achieve the same effects and functions as those of the electrical contact pair and the connector terminal pair of Embodiment 1.

Experimental Example

Hereinafter, more specific description will be given with reference to an experimental example.

Test Piece Manufacturing

A surface of a clean copper alloy plate having a thickness of 250 μm was subjected to electrolytic plating to form a Ni plated film having a thickness of 1 μm. Then, a surface of this Ni plated film was subjected to electrolytic plating to form an Ag plated film having a thickness of 1.3 μm, a Sn plated film having a thickness of 1.4 μm, and an Ag plated film having a thickness of 2.3 μm in this order, and then the resultant of the above processing was reflow processed under 290° C. Accordingly, on the surface of the copper alloy plate, the Ni layer (thickness of 1 μm), the Ag—Sn alloy layer (thickness of 4 μm), and the Ag layer (thickness of 1 μm) were formed in this order. Then, a part of this copper alloy plate was bulged from the bottom surface toward the top surface thereof so as to have a curvature radius of 3 mm, and thus a substantially hemispherical protrusion portion was obtained. With this, a test piece 1A was obtained. Note that the test piece 1A was made to simulate the first electrical contact that constitutes an electrical contact pair.

Furthermore, a test piece 1B was obtained in the same manner as the test piece 1A was manufactured, except for a substantially hemispherical protrusion portion having the curvature radius of 1 mm being formed. Note that the test piece 1B was made to simulate the first electrical contact that constitutes the electrical contact pair.

Furthermore, a surface of a clean copper alloy plate having a thickness of 250 μm was subjected to electrolytic plating to form a Ni plated film having a thickness of 1 μm. Then, a surface of this Ni plated film was subjected to electrolytic plating to form an Ag plated film having a thickness of 5 μm. Accordingly, a test piece 2 that includes, on the surface of the copper alloy plate, the Ni layer (thickness of 1 μm), and the Ag layer (thickness of 5 μm) in this order was obtained. Note that the test piece 2 was made to simulate the second electrical contact that constitutes the electrical contact pair.

Friction Wear Test

The test piece 1A or the test piece 1B was held in a state in which the top of its protrusion portion was in contact with the Ag layer of the test piece 2 in a vertical direction, and a predetermined load (N) shown in Table 1 was applied in the vertical direction using a piezo actuator. This is a simulation of the electrical contact pair that includes the contact portion in which the test piece 1A or the test piece 1B are in contact with the test piece 2. Then, both test pieces were caused to slide against each other by pulling the test piece 1A or the test piece 1B at a speed of 10 mm/min for 25 mm in a horizontal direction while under the application of the predetermined load. Subsequently, the protrusion portion was observed, and the area of a sliding track was obtained. Then, for ease, this area of the sliding track was assumed to be a contact area ($mm^2$) of the contact portion between the test piece 1A or the test piece 1B and the test piece 2, and the contact pressure ($N/mm^2$) was obtained by subtracting the applied load by the contact area. Furthermore, a distance between the front end of the protrusion portion before the test, and the surface of the sliding track formed on the protrusion portion after the test was measured using a confocal microscope ("OPTELICS H1200" of the Lasertec Corporation), and the area of the sliding track was multiplied by the obtained distance to obtain, for ease, the wear volume ($\mu m^3$). The results are collectively shown in Table 1. Furthermore, FIG. 7 shows the relationship between the contact pressure ($N/mm^2$) that is exerted on the contact portion, and the wear volume ($\mu m^3$).

TABLE 1

| | Load (N) | Contact Pressure ($N/mm^2$) | Wear Volume × $10^6$ ($\mu m^3$) |
|---|---|---|---|
| Test piece 1A + Test piece 2 | 3 | 129.6 | 0.074 |
| | 5 | 337.4 | 0.093 |
| | 8 | 381.3 | 0.120 |
| | 10 | 396.9 | 0.113 |
| | 15 | 477.6 | 0.142 |
| | 20 | 556.7 | 0.346 |
| Test piece 1B + Test piece 2 | 3 | 299.0 | 0.079 |
| | 5 | 364.5 | 0.125 |
| | 8 | 435.0 | 0.110 |
| | 10 | 519.9 | 0.207 |
| | 20 | 556.7 | 0.230 |
| | 30 | 628.9 | 0.580 |

Figure 7:
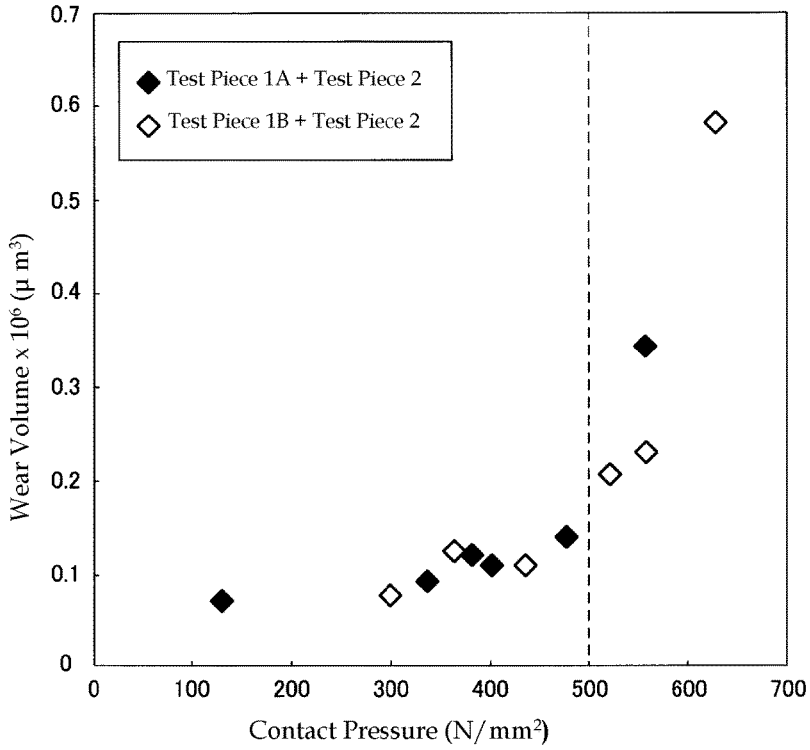
FIG. 7 is a graph illustrating a relationship between the contact pressure ($N/mm^2$) that is exerted on a contact portion and the wear volume ($\mu m^3$), the relationship being obtained in an experimental example.

According to Table 1 and FIG. 7, it is clear that the wear volume drastically increases when the contact pressure that is exerted on the contact portion exceeds 500 $N/mm^2$. Furthermore, in the present example, although the contact pressure that is exerted on the contact portion is set to be equal to or greater than 100 $N/mm^2$, it is clear that a drastic increase in the wear volume is suppressed when the contact pressure that is exerted on the contact portion is not greater than 500 $N/mm^2$. In view of the results, restricting the contact pressure that is exerted on a contact portion to at most 500 $N/mm^2$ makes it possible to reduce the amount of sliding wear in the contact portion, compared to a case where the contact pressure that is exerted on a contact portion exceeds 500 $N/mm^2$.

The embodiments of the present invention have been described in detail, but the present invention is not limited to the above-described embodiments, and various modifications are possible within the scope without departing from the essence of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An electrical contact pair comprising:

a first electrical contact that includes a first conductive base material, a silver-tin (Ag—Sn) alloy layer that is laminated on a surface of the first conductive base material with a nickel (Ni) layer and/or a Ni alloy layer interposed therebetween, and a first silver (AG) layer that is laminated on a surface of the Ag—Sn alloy layer, the first AG layer being exposed as an outermost surface;

a second electrical contact that includes a second conductive base material, and a second AG layer that is laminated on a surface of the second conductive base material with a Ni layer and/or a Ni alloy layer interposed therebetween, the second AG layer being exposed as an outermost surface; and a contact portion in which a surface of the first AG layer of the first electrical contact and a surface of the second AG layer of the second electrical contact are in contact with each other, wherein contact pressure that is exerted on the contact portion is in a range from 100 $N/mm^2$ to 500 $N/mm^2$ inclusive.

2. The electrical contact pair according to claim 1, wherein the first AG layer is thinner than the second AG layer.

3. The electrical contact pair according to claim 1, wherein the first conductive base material and the second conductive base material are made of copper or a copper alloy, or aluminum or an aluminum alloy.

4. A connector terminal pair comprising the electrical contact pair according to claim 1.

5. The connector terminal pair according to claim 4, wherein a first terminal that includes the first electrical contact, and a second terminal that includes the second electrical contact are provided, and the first terminal and the second terminal are fitted to each other to form the contact portion.

* * * * *